United States Patent [19]

Bosley

[11] Patent Number: 4,712,081

[45] Date of Patent: Dec. 8, 1987

[54] BLADE FUSE ASSEMBLY WITH INDICATOR

[76] Inventor: Sydney S. Bosley, 67 Holly Ave., New-Haw, Weybridge, Surrey, England

[21] Appl. No.: 884,380

[22] Filed: Jul. 11, 1986

[30] Foreign Application Priority Data

Jul. 12, 1985 [GB] United Kingdom ..... 8517590

[51] Int. Cl.[4] ..... H01H 85/32

[52] U.S. Cl. ..... 337/266; 337/242

[58] Field of Search ..... 337/266, 241, 242

[56] References Cited

U.S. PATENT DOCUMENTS 4,308,516 12/1981 Shimada et al. ..... 337/241

4,499,447 2/1985 Greenberg ..... 337/266

*Primary Examiner*—Harold Broome

*Attorney, Agent, or Firm*—Shlesinger, Arkwright & Garvey

[57] ABSTRACT

A fuse is arranged to glow brightly when it blows. The fuse incorporates a bulb positioned snugly in a pocket in a base of the fuse housing, the bulb being connected electrically in parallel with fusible metal strip.

10 Claims, 4 Drawing Figures

BLADE FUSE ASSEMBLY WITH INDICATOR

BACKGROUND OF THE INVENTION

The present invention relates to electrical fuses, for example fuses for use in a vehicle fuse box. The invention will be described with reference to a well known type of vehicle fuse, although the invention is also applicable to other fuses. Many modern vehicles have fuse boxes fitted with so called "blade fuses". The term "blade fuse" is well known in the art and it refers to a small fuse with contact legs which are in the form of narrow blades which lie in the same plane, the fuse being quite narrow when measured transverse to said plane. The fuse has a plastics material housing from the base of which the contact legs emerge, the contact legs being connected together by fuse metal which extends between the legs in an upper portion of the fuse housing. The top of the fuse housing has an opening through which the fuse metal is visible. In the event that a piece of electrical equipment on a vehicle should cease to function, the motorist may suspect that a fuse has blown. In order to check for a blown fuse, the motorist must located the fuse box, and must look through the openings in the tops of the fuse housings of each fuse to see if the fuse metal has melted in any fuse. However, because fuse boxes are often positioned in inaccessible and/or dark locations (for example beneath a vehicle dash board) the motorist may need to use a torch to illuminate the fuses, and may have to contort his body to an awkward position in order to be able to view the fuses. Even when the motorist has viewed the tops of the fuses, it may not be clear whether or not a fuse has blown, and it may be necessary to remove each fuse in turn to inspect it more carefully.

SUMMARY OF THE INVENTION

It is an object of the invention to provide a fuse which will overcome the problems described above, and will give a clearly visible indication if it has blown.

According to the invention, a fuse comprises a fuse housing (made for example of an electrically insulating plastic);

two spaced apart contact legs disposed partly inside the fuse housing with end regions of said legs extending outwardly from a base of the housing for effecting electrical contact (with corresponding contacts on a fuse holder);

fusible material (for example fuse metal) disposed within the fuse housing and electrically connecting the contact legs to one another;

a bulb (or other light emitting member) electrically connecting the contact legs and arranged electrically in parallel with the fusible material so that when the fuse blows (i.e. when the fuse metal melts) the bulb will glow to give warning that the fuse has blown;

said fuse housing having structure defining a pocket therewithin, the pocket being disposed between the contact legs and in the base region of the fuse housing, the bult or other light emitting member being disposed in said pocket.

It is preferred to make the fuse housing of a suitable light conducting material so that when the fuse blows the entire fuse housing lights up or glows and gives an immediate indication as to which fuse has blown. It is believed that this effect is achieved by the choice of position of the bulb in a pocket in the base of the fuse housing between the contact legs. If the bulb were to be in the upper region of the fuse housing then the light would shine straight into the viewers eye through the inspection opening in the top of the fuse housing and the bulb would not light up the whole fuse housing. When the entire fuse housing lights up, it will have the advantage that the colour of the plastics material from which the fuse is made is clearly visible. This is important because fuses are usually colour coded, so that a fuse box will have fuses of different colours, and if a motorist or other person inspects a fuse box and sees one of the fuses glowing pink, he will know at once that the fuse has blown and will need to be replaced by a new fuse having a pink housing.

A further advantage of the chosen bulb position is that it is well protected in its pocket in the base of the fuse housing. Thus, the bulb is not likely to be accidentally broken by being knocked by a dropped tool or the like. Further, should the bulb shatter due to bulb failure, it is unlikely to harm the eyes or face of somebody looking at the fuse. Yet another advantage of the chosen position of the bulb is that electrical leads for the bulb can extend from the open base of the pocket to be readily connected to the contact legs close to where they emerge from the fuse housing, for example just outside the fuse housing.

A preferred embodiment of a fuse according to the invention will now be described with reference to the accompanying drawings.

DESCRIPTION OF THE PREFERRED EMBODIMENT

Figure 1:
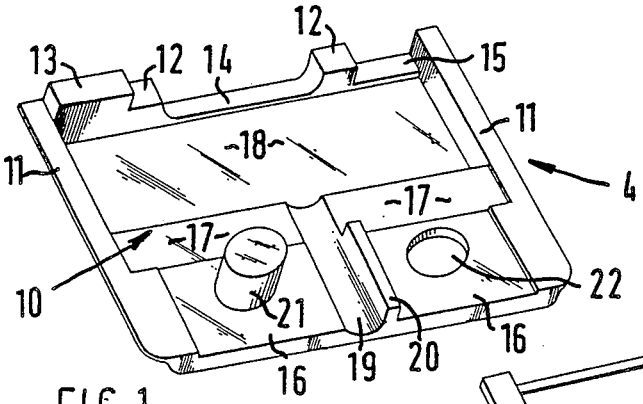
FIG. 1 is a perspective view of one half of a fuse housing of a fuse according to the invention.
Figure 2:
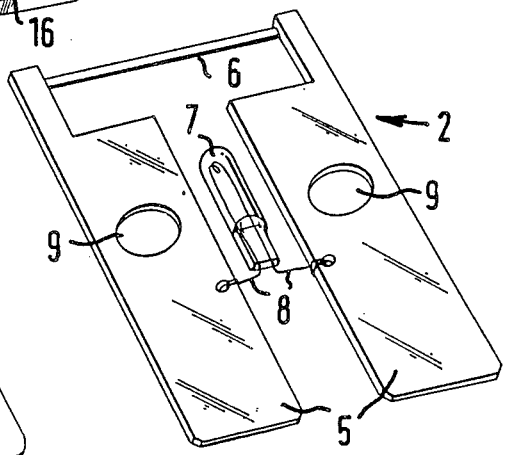
FIG. 2 is a plan view showing a pair of contact legs electrically connected together both by a piece of fuse metal and also by an incandescent lamp electrically in parallel with the fuse metal.
Figure 3:
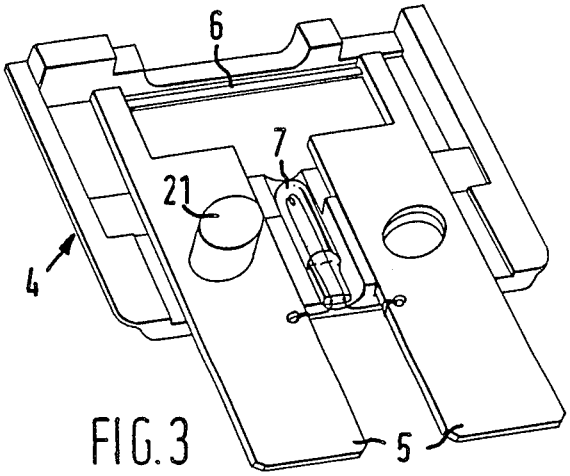
FIG. 3 is a view showing the electrical assembly of FIG. 1 connected to the housing half of FIG. 1.
Figure 4:
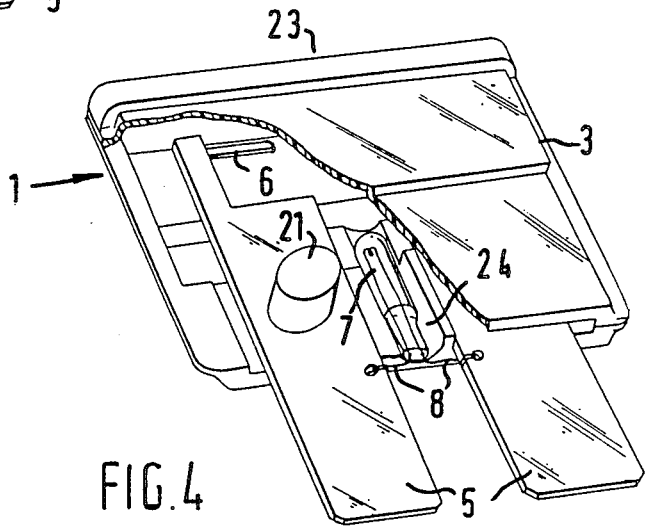
FIG. 4 is a view of a complete fuse, but with a part of the housing shown broken away to show a blown fuse.

The fuse 1 illustrated in FIG. 4 comprises an electrical assembly 2 shown in FIG. 2 which is held in place in a housing 3 which comprises two identical fuse housing halves 4 (FIG. 1) snap fitted together.

Referring now to FIG. 2, it will be seen that the electrical components of the fuse comprise a pair of contact legs 5 which are spaced apart and disposed parallel to one another. The fuse illustrated is designed as a blade fuse for automobile use, and so the contact legs are formed as flat blades disposed in a common plane. However, in a different design of fuse the legs could be disposed in parallel planes or could be of a different cross-section shape such as round.

At their upper ends the contact legs are electrically connected together by fusible material in the form of a low melting point metal strip 6.

Disposed between the contact legs 5 is a minature incandescent lamp or bulb 7 which is elongate and cylindrical. The bulb is only about a quater of an inch long, and it is disposed centrally between the contact legs and extending parallel to them. The upper end of the bulb terminates well short of the fuse metal strip 6. A pair of wires 8 extend from the base of the bulb 7, and these wires are connected one to each of the contact legs 5 so that the bulb is electrically in parallel with the fuse metal strip 6. The wires 8 can be connected to the contact legs 5 in any suitable way, such as soldering, and the contact legs 5 may have very small holes through which the ends of the wires 8 are passed. The contact legs each have a circular hole 9 through them for the purpose of mounting the legs in the housing 3.

As mentioned above, the housing 3 consists of two identical parts 4. Each part 4 is made of an electrically insulating plastics material which is transparent and coloured, the colour of the plastic indicating the fuse rating. Each housing part 4 has (as viewed in FIG. 1) a base wall 10, two upwardly extending side walls 11, and an upwardly extending top wall 12. The top wall 12 has at its left hand end an upwardly extending locking projection 13; has in its central region a depression 14; and has at its right hand end a dovetail depression 15. The base wall 10 also has a pair of contact-leg-receiving depressions 16, a pair of deeper depressions 17, and adjacent the wall 12 has a still deeper depression 18. A further deep depression 19 extends from the bottom edge of the base wall 10 in a direction towards the top of the fuse housing. This depression 19 is of semicircular cross-section and is bounded along its right hand edge by a raised wall 20. In the region of one of the depressions 16 is a raised boss 21 of circular cross-section, whereas in the region of the other depression 16 is a corresponding through hole 22.

In order to assemble the fuse, the electrical assembly 2 of FIG. 2 will first be laid on top of the housing half 4 of FIG. 1. When this is done, the upper regions of the contact legs will lie in the depressions 16, the fusible strip 6 will lie in the depression 18, and the regions where the fusible strip 6 is connected to the tops of the contact legs will lie in depressions 17. The bulb will lie in the depression 19, and the boss 21 will extend right through the hole 9 in one of the contact legs 5. To finally assemble the fuse, a second housing part 4 will be laid face down on top of first housing part, and the parts will be snap fitted together. The locking projection 13 of each housing half will snap into the dovetail depression 15 in the other housing half, and similarly the boss 21 on each housing half will snap fit into the through hole 22 on the other housing half. Each contact leg will be held in place firmly in spaces provided by the matching depressions in the housing parts, and each hole 9 in a contact leg will receive one of the bosses 21.

The two depressions 14 in the top walls 12 will provide an aperture 23, open at the top, through which the interior of the fuse can be viewed. The two depressions 19 together with the two raised bulb-retaining walls 20 will define a pocket 24 in which the bulb 7 is a tight or snug fit. This pocket will be open at the bottom end, and the wires 8 will pass out of the open bottom end of the pocket to be connected to the contact legs 5 just outside the housing 3.

The assembled fuse is shown in FIG. 4, and the fuse will be plugged into a vehicle fuse box by means of its contact legs which project below the fuse housing.

Operation of the fuse will now be described. When the fuse is in position in a fuse box, it will protect the electrical circuit of—say—the vehicle headlights. When the headlights are switched on, current will flow from one contact leg to the other through the fuse metal strip 6, and the headlights will operate. The bulb 7 will be of much higher electrical resistance than the fuse strip 6, so that only a very low current will pass through the bulb 7, and it will not light up.

Let us now suppose that for some reason the fuse blows (i.e. strip 6 melts). The current for the headlights will no longer be able to pass through the melted fuse strip, and so the larger part of the vehicle battery voltage will be applied across the bulb 7 causing it to glow brightly. It has been found that with the position of the bulb shown in the drawings, light from the fuse is conducted all around the fuse housing, causing the fuse housing to glow brightly with the colour of the plastic from which it is made.

Thus, a motorist who suddenly finds that his headlights have failed will be able to look at the fuse box and will see at once that a fuse is glowing and has thus failed. The motorist will then merely have to remove the glowing fuse and replace it with a fuse of the same colour coding. Unless there is some fundamental fault, the lights will then work again.

A major advantage of the glowing fuse is that a motorist will be encouraged to perform "on the spot" changing of a fuse. It may well be very dangerous or impossible for a motorist to operate a modern vehicle in modern motoring conditions with part of the vehicle equipment such as the windscreen wipers, lights, direction indicators, or an on-board engine control computer not working, and many people would be tempted to drive the vehicle on in its dangerous condition in the absence of a ready indication of a blown fuse.

The particular advantages of the chosen position of the bulb have already been described above, and these are most important for ease of use, reliability, and safety. The fuse described uses an incandescent lamp, but any other suitable light emitting member could be used.

If a bulb is used, then to enable the fuse to be used on a wide range of vehicles, e.g. motor bikes, cars and trucks, the bulb should have a wide voltage tolerance, so that it will glow adequately at 6 volts, and yet not be destroyed by 24 volts.

Although the bulb illustrated gives out a steady light, it is instead possible for the bulb to include a bi-metallic contact so that it flashes on and off.

The fuse housing could be made of a translucent material instead of transparent material.

I claim:

1. A blade fuse assembly comprising:

(a) a light conducting fuse housing including a top portion and a base portion, (b) a pair of spaced apart contact legs disposed partially within said fuse housing and having end portions extending outwardly from said base portion of said fuse housing for effecting electrical contact, (c) a fusible member disposed within said fuse housing electrically connecting said contact legs to one another, (d) said fuse housing having structure defining a pocket therewithin, said pocket being disposed between said contact legs and in said base portion of said fuse housing below said fusible member, and (e) an electrically activatable light emitting member positioned within said pocket and electrically connecting said contact legs in parallel with said fusible member, wherein upon failure of said fusible member, said light emitting member will activate to emit light within said fuse housing causing said entire light conducting fuse housing to glow.

2. A blade fuse assembly as in claim 1, wherein:

(a) said light conducting fuse housing is made of transparent material.

3. A blade fuse assembly as in claim 1, wherein:
(a) said light conducting fuse housing is made of translucent material.
4. A blade fuse assembly as in claim 1, wherein:
(a) said light conducting fuse housing is made of a plastic material, and
(b) said plastic material being of a selected color indicating the rating of said fuse.
5. A blade fuse assembly as in claim 1, wherein:
(a) said pocket providing a snug fit for receiving said light emitting member.
6. A blade fuse assembly as in claim 1, wherein:
(a) said pocket being open at said base portion of said fuse housing.
7. A blade fuse assembly as in claim 1, wherein:
(a) said pocket being elongate, and extending with its axis parallel to said contact legs.
8. A blade fuse assembly as in claim 1, wherein:
(a) said light emitting member comprising an incandescent lamp, and
(b) said incandescent lamp including a pair of wires extending therefrom and being electrically connected to a respective contact leg exteriorly of said fuse housing in a region adjacent to said base portion of said housing.
9. A blade fuse assembly as in claim 1, wherein:
(a) said light emitting member having a wide voltage tolerance such that it will glow adequately at 6 volts, and will sustain a voltage of 24 volts without being destroyed.
10. A blade fuse assembly as in claim 1, wherein:
(a) said blade fuse assembly being positionable in a vehicle fuse box.

* * * * *